US011246423B2

(12) United States Patent
Kulik et al.

(10) Patent No.: US 11,246,423 B2
(45) Date of Patent: Feb. 15, 2022

(54) CONVERTIBLE COUCH, TWIN BED, AND QUEEN BED

(71) Applicant: Milliard Enterprises Limited Liability Company, Lakewood, NJ (US)

(72) Inventors: Simi Kulik, Toms River, NJ (US); Yaakov Landsman, Lakewood, NJ (US)

(73) Assignee: Milliard Enterprises Limited Liability Company, Lakewood, NJ (US)

( * ) Notice: Subject to any disclaimer, the term of this patent is extended or adjusted under 35 U.S.C. 154(b) by 0 days.

(21) Appl. No.: 17/006,032

(22) Filed: Aug. 28, 2020

(65) Prior Publication Data

US 2021/0059419 A1 Mar. 4, 2021

Related U.S. Application Data

(60) Provisional application No. 62/892,946, filed on Aug. 28, 2019.

(51) Int. Cl.

| | |
|---|---|
| ***A47C 17/23*** | (2006.01) |
| ***A47C 17/13*** | (2006.01) |
| ***A47C 17/04*** | (2006.01) |

(52) U.S. Cl.

CPC ..... *A47C 17/23* (2013.01); *A47C 17/045* (2013.01); *A47C 17/138* (2013.01)

(58) Field of Classification Search

CPC ... A47C 17/045; A47C 17/134; A47C 17/138; A47C 17/1655; A47C 17/23; A47C 17/32; A47C 17/207; A47C 4/30; A47C 31/02

See application file for complete search history.

(56) References Cited

U.S. PATENT DOCUMENTS

| | | | | | |
|---|---|---|---|---|---|
| 2,023,605 | A | * | 12/1935 | Mandell | A47C 17/207 5/46.1 |
| 2,568,366 | A | * | 9/1951 | Rosen | A47C 17/2073 5/18.1 |
| 2,997,724 | A | * | 8/1961 | Heumann | A47C 17/132 5/18.1 |
| 3,740,774 | A | * | 6/1973 | Powell | A47C 17/045 5/12.1 |

(Continued)

FOREIGN PATENT DOCUMENTS

| | | | | | |
|---|---|---|---|---|---|
| FR | 2996740 | A3 | * | 4/2014 | A47C 17/045 |
| GB | 2473819 | A | * | 3/2011 | A47C 17/045 |

(Continued)

*Primary Examiner* — David R Hare

(74) *Attorney, Agent, or Firm* — William G. Heedy; The Van Winkle Law Firm

(57) ABSTRACT

A convertible couch, twin bed, and queen bed includes a U-shaped section having a first arm, a second arm, and a back section; a first end section; a second end section; and first, second and third mattress sections; the first mattress section is rotatably joined to the second mattress section, which is rotatably joined to the third mattress section, which has a first bottom edge and an opposing second bottom edge; the first mattress section has an internal first edge and an opposing internal section edge; the internal first edge has a second portion of the first zipper, and the internal second edge has a second portion of the second zipper; the first zipper releasably joins the first end section and the first mattress section, and the second zipper releasably joins the second end section and the first mattress section.

6 Claims, 9 Drawing Sheets

(56) References Cited

U.S. PATENT DOCUMENTS 3,807,801 A * 4/1974 Dalsgard ..... A47C 27/00 297/452.16
4,443,901 A * 4/1984 Zimmerman ..... A47C 17/24 5/12.1
6,668,394 B2 * 12/2003 Walpin ..... A01K 1/0353 119/28.5
7,331,074 B2 * 2/2008 Wu ..... A47C 17/045 5/12.1
7,555,797 B1 * 7/2009 Wu ..... A47C 17/04 5/710
7,648,197 B1 * 1/2010 Delmestri ..... A47C 17/16 297/63
8,091,159 B2 * 1/2012 Harris ..... A47C 17/2073 5/18.1
9,144,318 B1 * 9/2015 Lagier ..... A47C 17/045
10,758,049 B2 * 9/2020 Cooper ..... A47C 27/081
D897,700 S * 10/2020 Kulik ..... A47C 27/00 D6/335
2006/0163935 A1 * 7/2006 Harris ..... A47C 17/045 297/452.41
2016/0088951 A1 * 3/2016 McGuinness ..... A47C 4/028 297/440.14
2016/0174715 A1 * 6/2016 Nelson ..... A47C 4/028 297/440.14
2018/0303242 A1 * 10/2018 Nitori ..... A47C 19/22

FOREIGN PATENT DOCUMENTS

KR 20130002866 U * 5/2013 ..... A47C 17/045
WO WO-2009031875 A1 * 3/2009 ..... A47C 13/005

* cited by examiner

CONVERTIBLE COUCH, TWIN BED, AND QUEEN BED

CROSS-REFERENCE TO RELATED APPLICATIONS

The present application claims the priority of U.S. Provisional Patent Application Ser. No. 62/892,946 filed Aug. 28, 2019, entitled "Convertible Couch, Twin Bed, and Queen Bed" and is incorporated herein in its entirety.

FIELD OF THE INVENTION

This invention relates to multi-use furniture and, more particularly, a convertible couch, twin bed, and queen bed.

DESCRIPTION OF THE BACKGROUND

Many attempts have been made to make couch and bed combination inventions. Most common are the sleeper sofa having a concealed pull-out bed, the futon, and the daybed. Each of these couch and bed combinations suffer from deficiencies, however, typically relating to comfort in one configuration relative to the other, ease of transitioning between different configurations, superfluous pieces, and a general inability to be configured into a configuration other than a couch and one bed form.

SUMMARY OF THE INVENTION

In accordance with one form of the present invention, there is provided a convertible couch, twin bed, and queen bed includes a U-shaped section having a first arm, a second arm, and a back section between, and joined to, the first arm and the second arm; the first arm has a face distal to the back section, the face having a top edge; the second arm has a face distal to the back section, the face having a top edge; a first end section has a front edge, an internal bottom edge, and an internal top edge; the front edge of the first end section is rotatably joined to the top edge of the face of the first arm; a second end section has a front edge and a bottom edge; the front edge of the second end section is rotatably joined to the top edge of the face of the second arm; the internal top edge of the first end section has a first portion of a first zipper and the internal top edge of the second end section has a first portion of a second zipper; and a mattress including a first mattress section, a second mattress section, and a third mattress section; and the first mattress section is rotatably joined to the second mattress section, and the second mattress section is rotatably joined to the third mattress section; the third mattress section has a first bottom edge and an opposing second bottom edge; the first bottom edge of the third mattress section is joined to the bottom edge of the first end section, and the second bottom edge of the third mattress section is joined to the bottom edge of the second end section; the first mattress section has an internal first edge and an opposing internal section edge; the internal first edge has a second portion of the first zipper, and the internal second edge has a second portion of the second zipper; the first zipper releasably joins the first end section and the first mattress section, and the second zipper releasably joins the second end section and the first mattress section.

DETAILED DESCRIPTION

Figure 1:
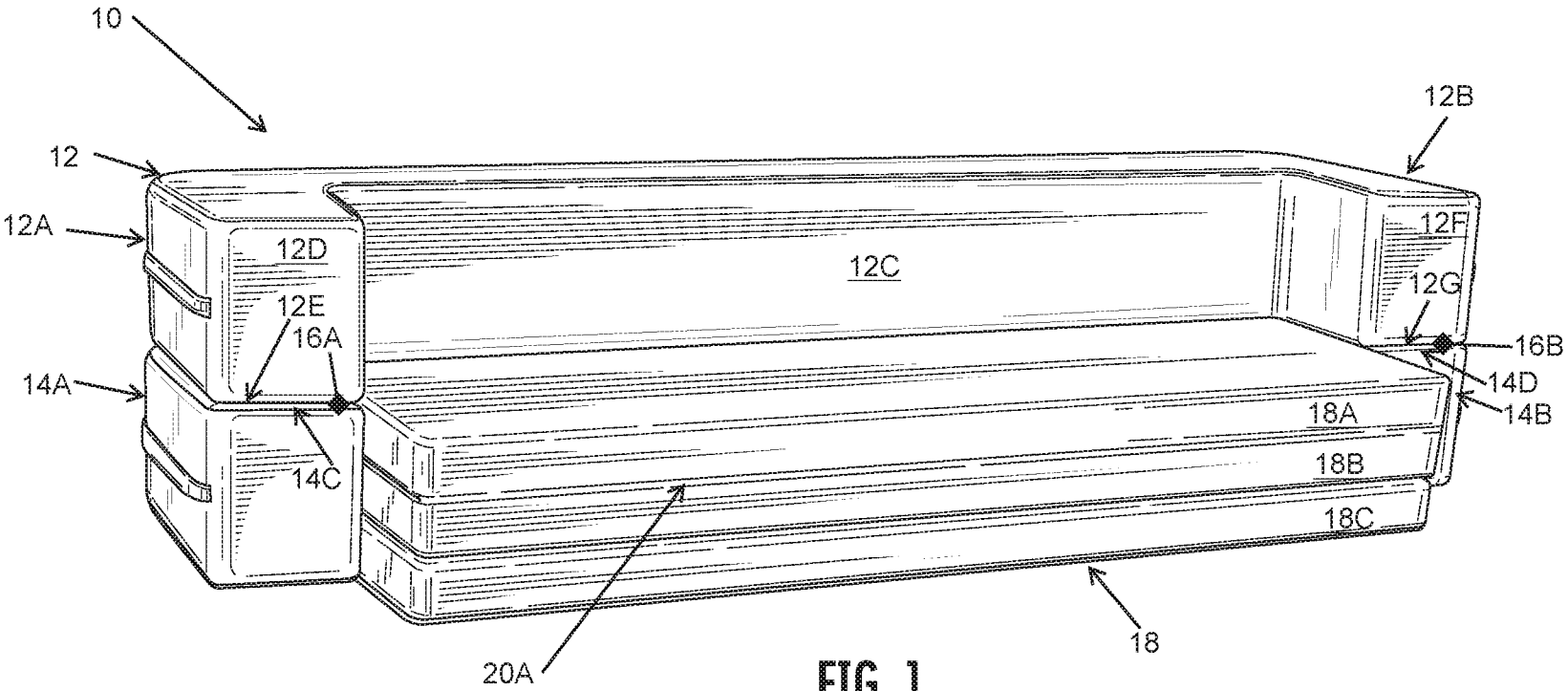
FIG. 1 is a perspective view of the convertible couch, twin bed, and queen bed in a first configuration.
Figure 2:
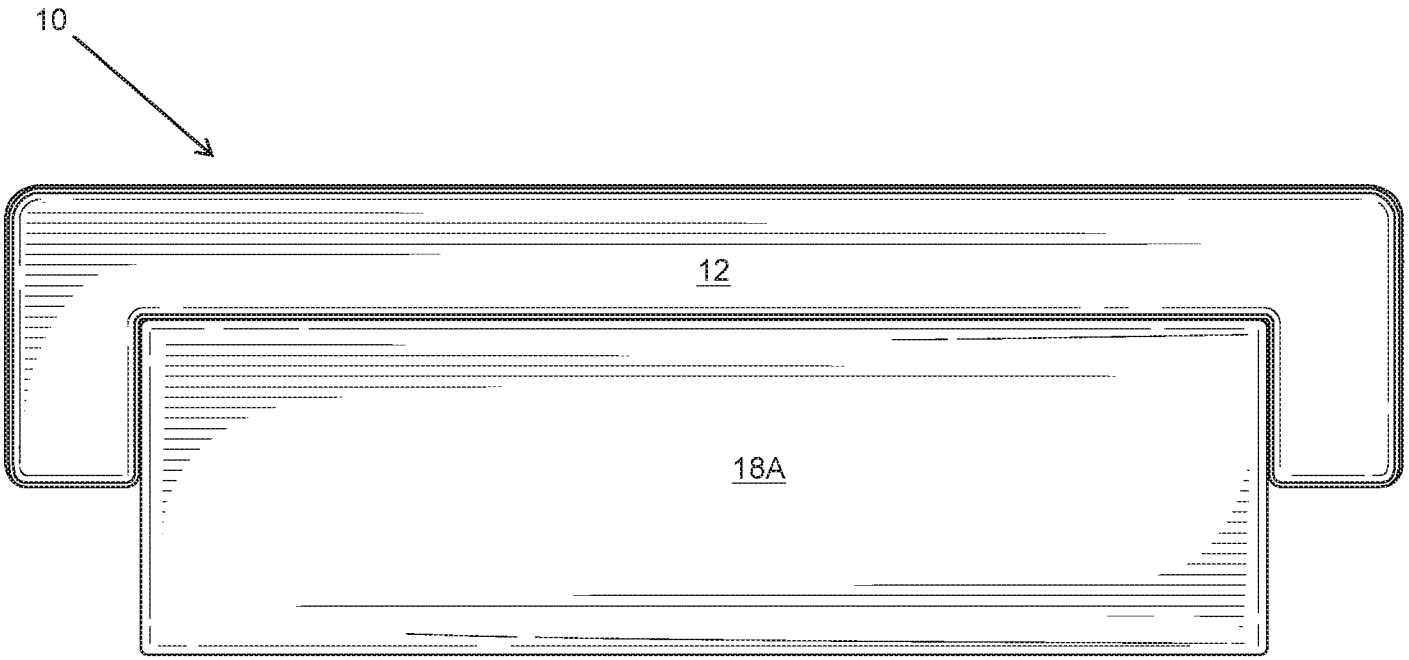
FIG. 2 is a top plan view thereof.
Figure 3:
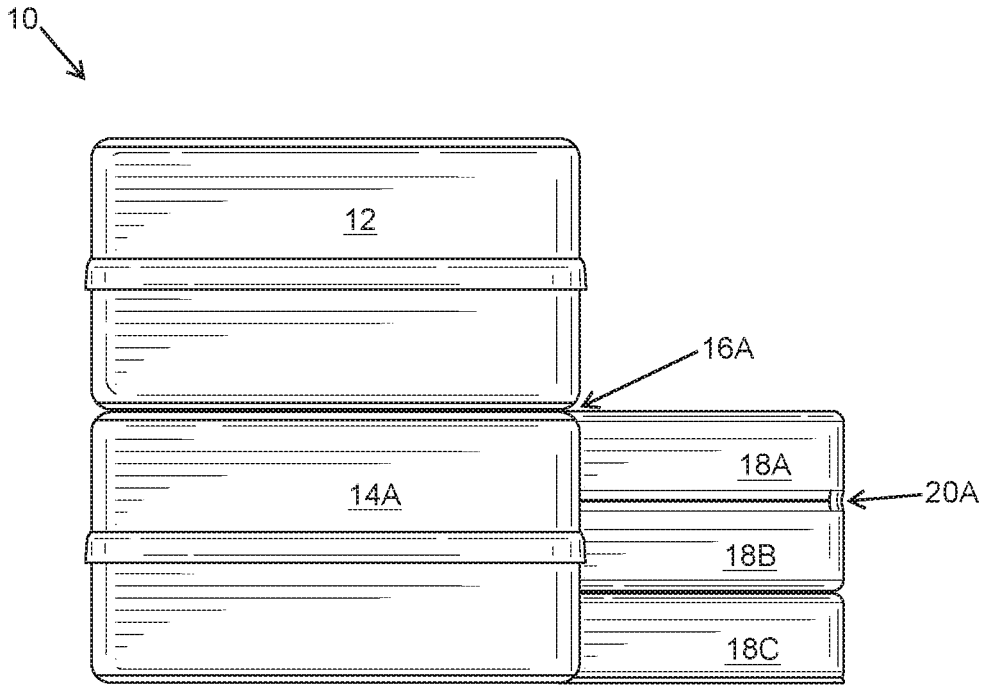
FIG. 3 is a side elevational view thereof.

A convertible couch, single bed, and queen bed (the "article") is disclosed. FIGS. 1-3 are different views of the article 10 configured as a couch.

The article 10 has a U-shaped section 12, a first end section 14A, a second end section 14B, and a mattress section 18.

The U-shaped section 12 has a first arm 12A, a second arm 12B, and a back section 12C. The back section 12C is between, and joined to, the first arm 12A and the second arm 12B. The U-shaped section 12 may be a manufactured as a single component or may be manufactured as separate components which are joined together at a desired later time, such as installation in a dwelling. The first arm 12A has a face 12D distal to the back section 12C, and the face 12D has a frontal bottom edge 12E. The second arm 12B has a face 12F distal to the back section 12C, and the face 12F has a frontal bottom edge 12G. In the couch configuration the U-shaped section 12 rests on the end sections 14A, 14B, and a portion of the mattress sections 18A-18C.

Figure 7:
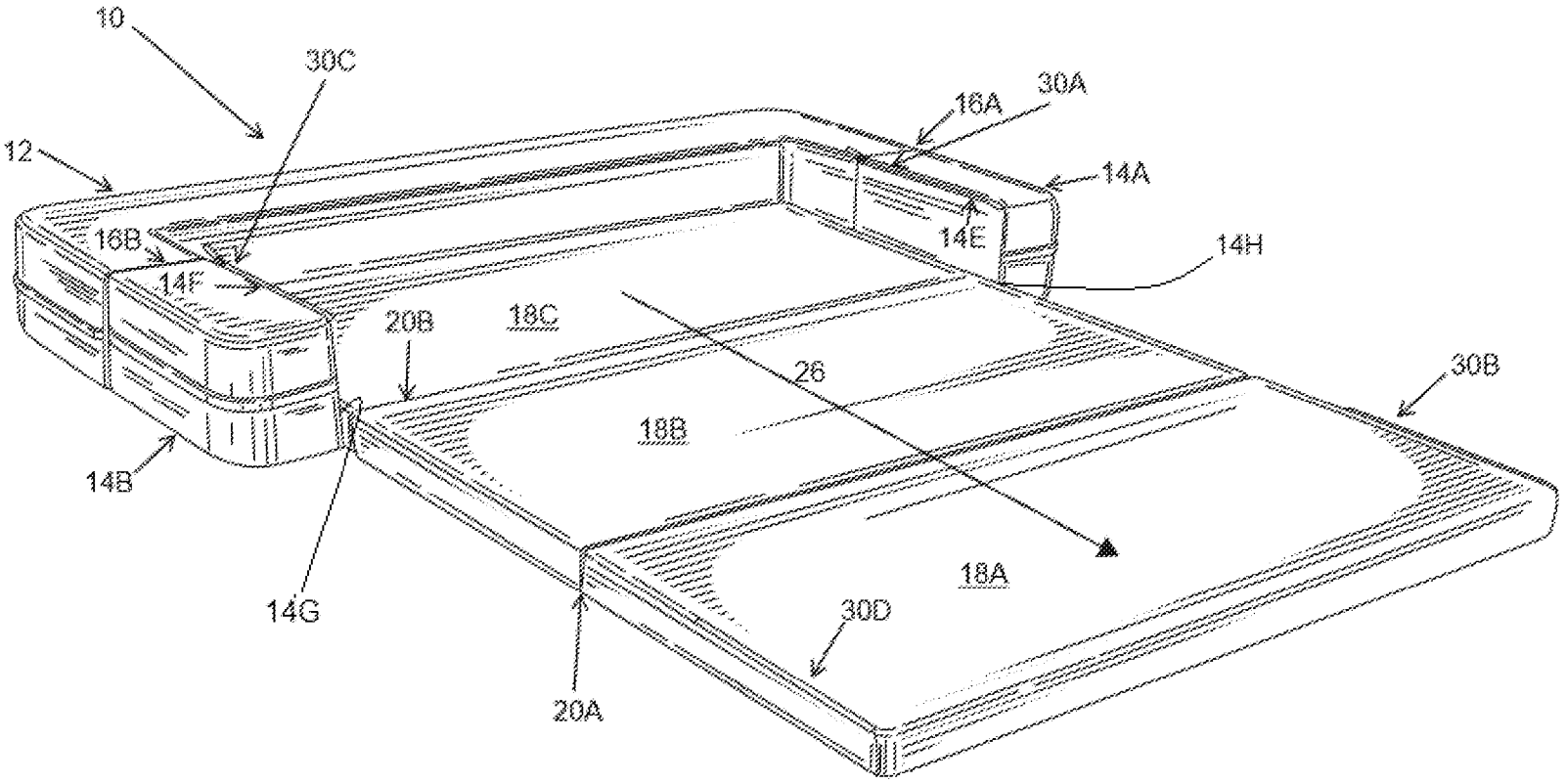
FIG. 7 is a perspective view of the convertible couch, twin bed, and queen bed in the third configuration.

The first end section 14A has an upper front edge 14C, an internal bottom edge 14G, and an internal top edge 14E (FIG. 7). The upper front edge 14C of the first end section 14A is rotatably joined to the frontal bottom edge 12E of the first arm 12A by a hinge or joint 16A. The hinge 16A may be thread, fabric, or other means of rotatably joining the upper front edge 14C to the frontal bottom edge 12E. The internal top edge 14E of the first end section 14A has a first part 30A of a first zipper (FIG. 7).

Figure 6:
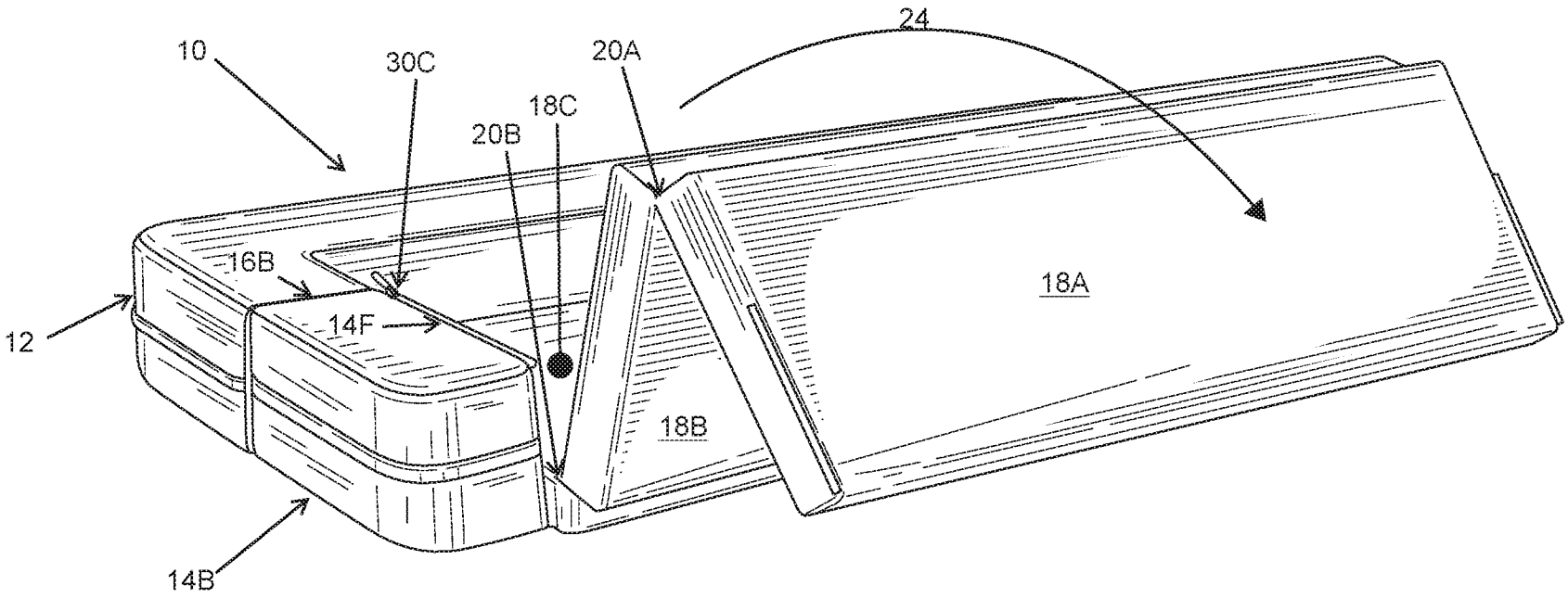
FIG. 6 is a is a perspective view illustrating movement of the convertible couch, twin bed, and queen bed from the second configuration to a third configuration.

The second end section 14B has an upper front edge 14D, an internal bottom edge 14H, and an internal top edge 14F (FIG. 6). The upper front edge 14D of the second end section 14B is rotatably joined to the frontal bottom edge 12G of the second arm 12B by a hinge or joint 16B. The hinge 16B may be thread, fabric, or other means of rotatably joining the upper front edge 14D to the frontal bottom edge 12G. The internal top edge 14F of the second end section 14B has a first part 30C of a second zipper (FIGS. 6, 7).

The first mattress section 18A has a second part 30B of the first zipper which mates with the first part 30A, and also has a second part 30D of the second zipper which mates with the first part 30C (FIG. 7). One part of a zipper 30A, 30B has one set of elements (teeth) and a slide, and the other portion of the zipper has another set of elements. One part of a zipper 30C, 30D has one set of elements (teeth) and a slide, and the other portion of the zipper has another set of elements. In FIGS. 6 and 7, the slides are shown as being associated with the end sections 14A, 14B. In another embodiment, the slides may be associated with the mattress section 18A.

Figure 4:
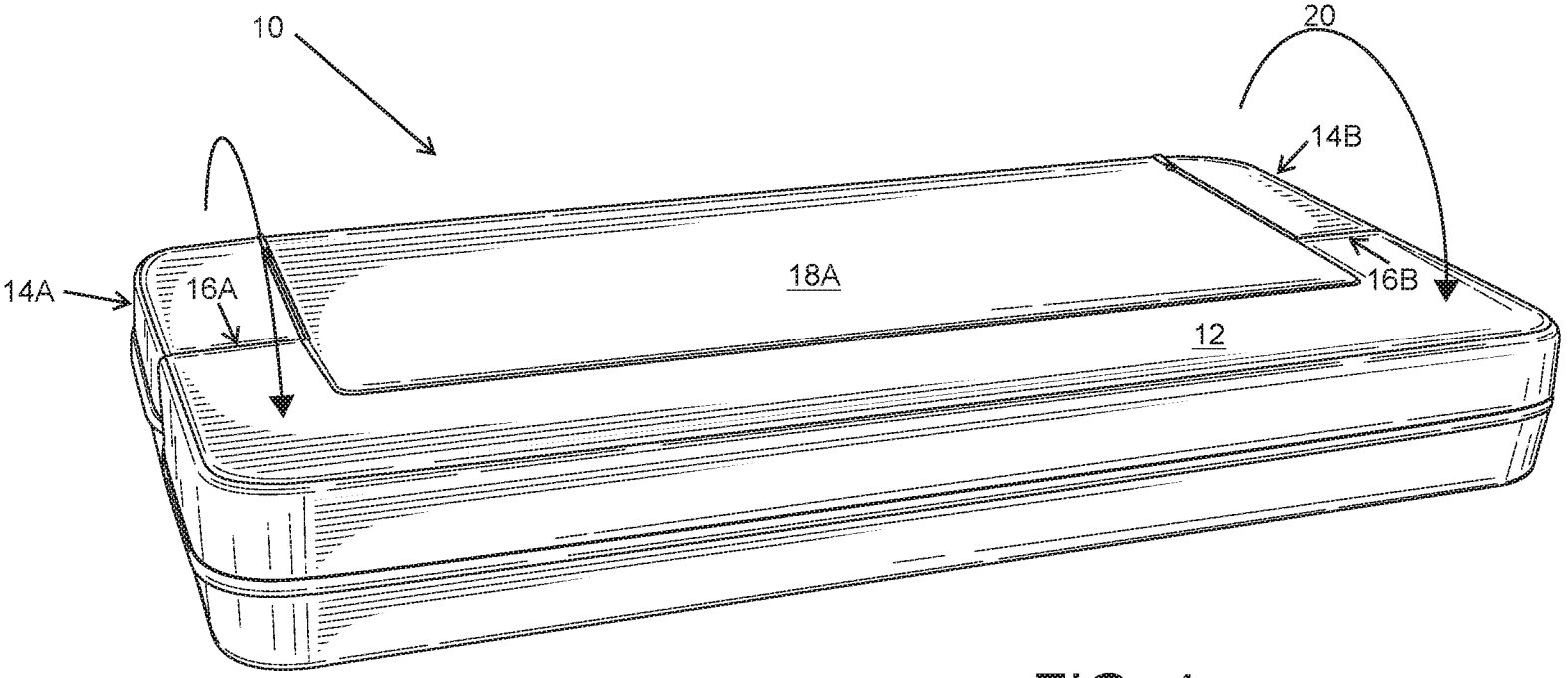
FIG. 4 is a perspective view illustrating movement of the convertible couch, twin bed, and queen bed from the first configuration to a second configuration.

FIG. 4 illustrates the article 10 configured as a twin bed. A rotating or folding action 20 converts the article 10 from a couch into a twin bed or a day bed. The U-shaped section 12 is rotated 20, or folded over, along the hinges 16A, 16B, so that the mattress sections 18A-18C are partially enclosed within the U-shaped section 12.

Figure 5:
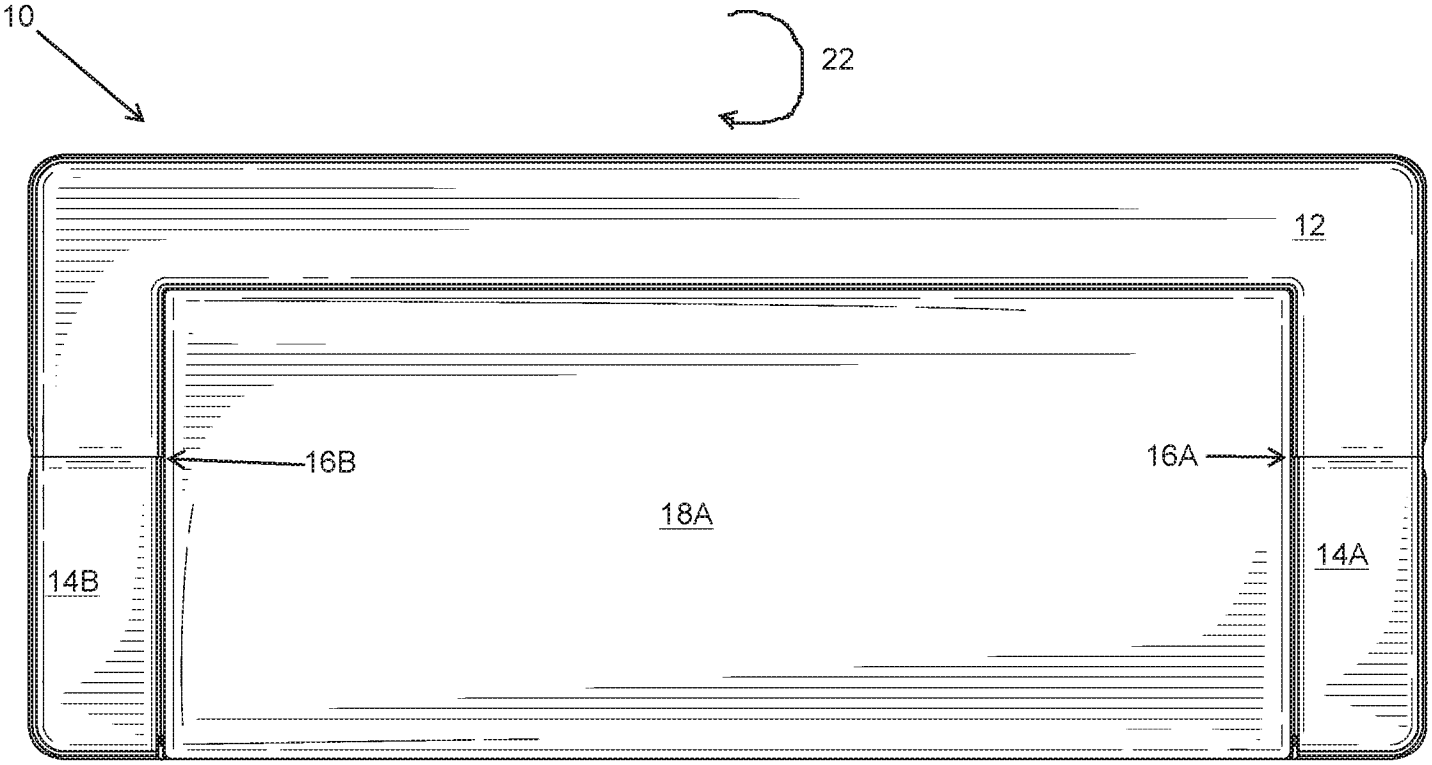
FIG. 5 is a top plan view thereof.

FIG. 5 illustrates the article 10 rotated 22 by 180 degrees (with respect to FIG. 4) in preparation for conversion into a queen bed. If the back section 12C (FIG. 1) is against a wall or a piece of furniture (not shown) then the article 10 may be moved away from the wall or piece of furniture to provide space for the conversion, or the article 10 may be rotated as shown. If the article 10 is positioned so that there is space for the mattress 18 to be unfolded, such as toward the center of a room, then movement or rotation may be avoided. For convenience of discussion below, the article 10 is shown as being rotated 22 (with respect to FIG. 4).

FIGS. 6 and 7 illustrate the article 10 being converted from a twin bed into a queen bed by unfolding the mattress 18. The zippers 30A-30D are unzipped so that the mattress section 18A may be unfolded from the mattress section 18B. The mattress sections 18A, 18B are then unfolded 24 along the hinges 20A, 20B.

Figure 8:
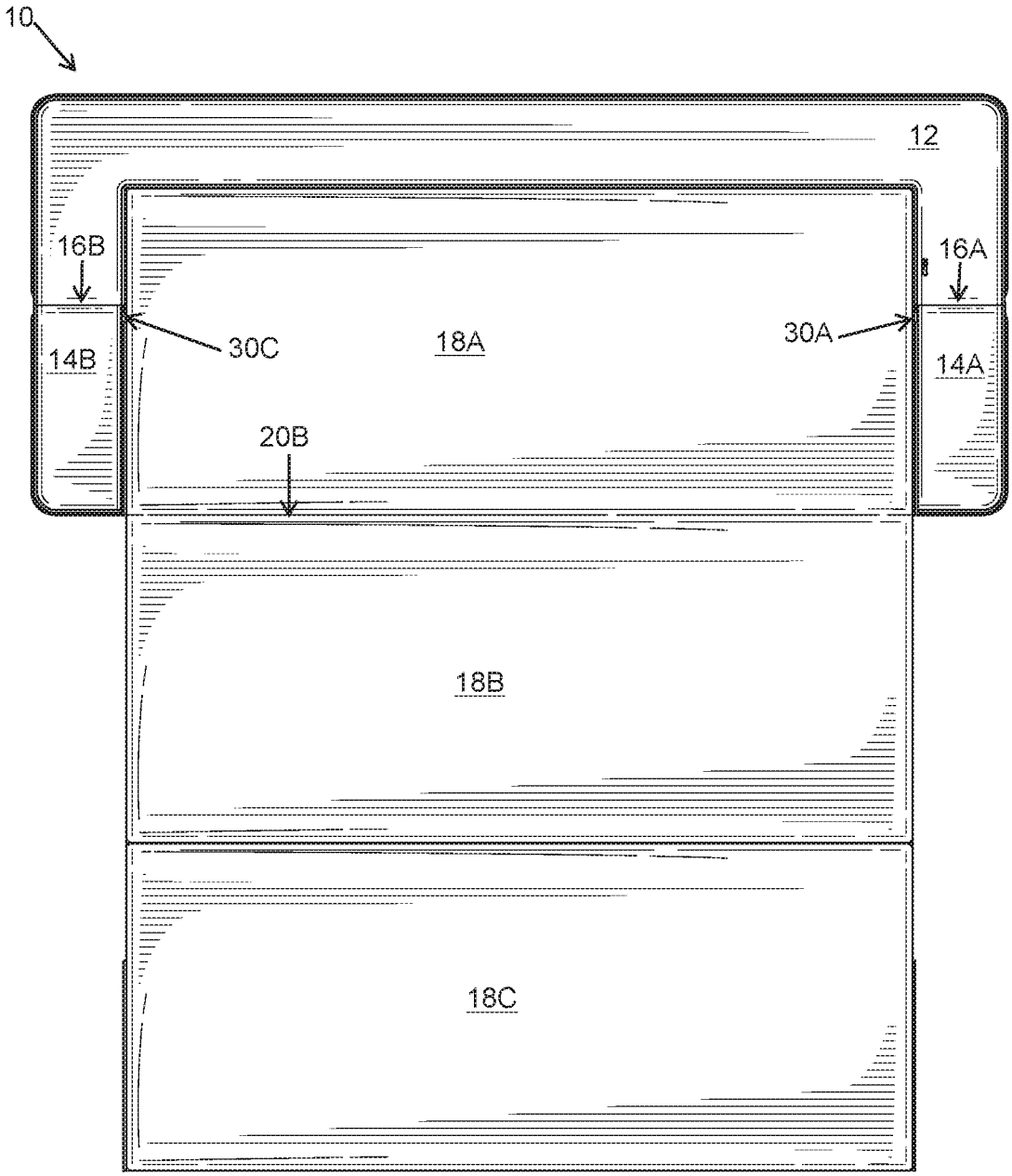
FIG. 8 is a top plan view thereof.
Figure 9:
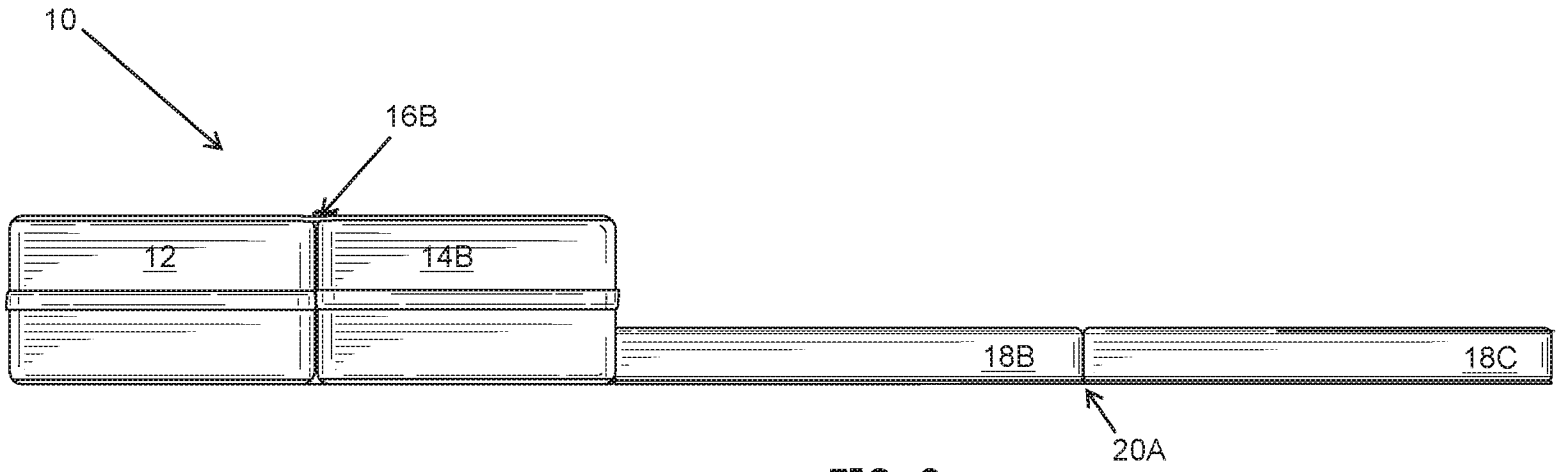
FIG. 9 is a side elevational view thereof.

FIGS. 7, 8 and 9 illustrate the article 10 configured as a queen bed.

If the article 10 is configured as a queen bed, then it is converted to a twin bed by folding up the mattress sections 18A, 18B, 18C and re-engaging the zipper parts-30D. If the article 10 is configured as a twin bed it is converted to a couch by rotating or folding (opposite to the rotation 20 of FIG. 3) the U-shaped section 12 back to an upright position.

In an embodiment, each mattress section 18A, 18B, 18C has a length of 60 inches, a depth of approximately 27 inches and a thickness of 3 inches, each end section 14A, 14B is 7 inches wide, approximately 18 inches deep, and 9 inches high, and U-shaped section 12 has a total length of 74 inches.

When configured as a couch, the article 10 has total length of 74 inches, with a seating area of 60 inches long by 19 inches deep, and with the seat of the couch being 9 inches above the floor. When configured as a twin bed, the article 10 is 74 inches long, approximately 38 inches wide, and 9 inches high. And, when configured as queen bed, the article 10 is 82 inches long, 60 inches wide, and 3 inches high.

Thus, an article of manufacture has been described which may be used as a couch, a twin bed, or a queen bed. The article comprises a U-shaped section having a first arm, a second arm, and a back section between, and joined to, the first arm and the second arm. The first arm has a face distal to the back section, the face having a top edge. The second arm has a face distal to the back section, the face having a top edge. A first end section has a front edge, an internal bottom edge, and an internal top edge. The front edge of the first end section is rotatably joined to the top edge of the face of the first arm. The second end section has a front edge and a bottom edge. The front edge of the second end section is rotatably joined to the top edge of the face of the second arm. The internal top edge of the first end section has a first portion of a first zipper and the internal top edge of the second end section has a first portion of a second zipper. A mattress has a first mattress section, a second mattress section, and a third mattress section. The first mattress section is rotatably joined to the second mattress section, and the second mattress section is rotatably joined to the third mattress section. The third mattress section has a first bottom edge and an opposing second bottom edge. The first bottom edge of the third mattress section is joined to the bottom edge of the first end section, and the second bottom edge of the third mattress section is joined to the bottom edge of the second end section. The first mattress section has an internal first edge and an opposing internal section edge. The internal first edge has a second portion of the first zipper, and the internal second edge has a second portion of the second zipper. The first zipper releasably joins the first end section and the first mattress section, and the second zipper releasably joins the second end section and the first mattress section.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims that may be written, for the subject invention.

The foregoing detailed description is intended only to convey to a person having ordinary skill in the art the fundamental aspects of the invention and is not intended to limit, and should not be construed as limiting, the scope of the invention.

What is claimed is:

1. A convertible couch, twin bed, and queen bed comprising:

a U-shaped section having a first arm, a second arm, and a back section between, and joined to, the first arm and the second arm; the first arm has a face distal to the back section, the face having a top edge; the second arm has a face distal to the back section, the face having a top edge;

a first end section has a front edge, an internal bottom edge, and an internal top edge; the front edge of the first end section is rotatably joined to the top edge of the face of the first arm;

a second end section has a front edge and a bottom edge; the front edge of the second end section is rotatably joined to the top edge of the face of the second arm; the internal top edge of the first end section has a first portion of a first zipper and the internal top edge of the second end section has a first portion of a second zipper; and a mattress comprising:

a first mattress section, a second mattress section, and a third mattress section; and the first mattress section is rotatably joined to the second mattress section, and the second mattress section is rotatably joined to the third mattress section; the third mattress section has a first bottom edge and an opposing second bottom edge; the first bottom edge of the third mattress section is joined to the bottom edge of the first end section, and the second bottom edge of the third mattress section is joined to the bottom edge of the second end section; the first mattress section has an internal first edge and an opposing internal section edge; the internal first edge has a second portion of the first zipper, and the internal second edge has a second portion of the second zipper; the first zipper releasably joins the first end section and the first mattress section, and the second zipper releasably joins the second end section and the first mattress section.

2. The convertible couch, twin bed, and queen bed as recited in claim 1 wherein the U-shaped section is formed as a single component.

3. The convertible couch, twin bed, and queen bed as recited in claim 1 wherein the U-shaped section is formed from separate components which are joined.

4. The convertible couch, twin bed, and queen bed as recited in claim 1 wherein each of the first, second and third mattress sections has a length of 60 inches, a depth of approximately 27 inches, and a thickness of 3 inches.

5. The convertible couch, twin bed, and queen bed as recited in claim 1 wherein each of the first and second end sections is 7 inches wide, approximately 18 inches deep, and 9 inches high.

6. The convertible couch, twin bed, and queen bed as recited in claim 1 wherein the U-shaped section has a length of 74 inches.

* * * * *